US011661686B2

(12) United States Patent
Shan et al.

(10) Patent No.: US 11,661,686 B2
(45) Date of Patent: May 30, 2023

(54) MECHANISM FOR RADIALLY INSERTING YARN INTO THREE-DIMENSIONAL BRAIDED PREFORM

(71) Applicant: NANJING UNIVERSITY OF AERONAUTICS AND ASTRONAUTICS, Nanjing (CN)

(72) Inventors: Zhongde Shan, Nanjing (CN); Jun Wang, Nanjing (CN); Yaoyao Wang, Nanjing (CN); Haoqin Yang, Nanjing (CN); Chao Li, Nanjing (CN)

(73) Assignee: NANJING UNIVERSITY OF AERONAUTICS AND ASTRONAUTICS, Nanjing (CN)

( * ) Notice: Subject to any disclaimer, the term of this patent is extended or adjusted under 35 U.S.C. 154(b) by 0 days.

(21) Appl. No.: 17/702,145

(22) Filed: Mar. 23, 2022

(65) Prior Publication Data

US 2022/0213627 A1 Jul. 7, 2022

(30) Foreign Application Priority Data

May 26, 2021 (CN) ..... 202110577670.X

(51) Int. Cl.
*D04C 3/48* (2006.01)
*D04C 3/40* (2006.01)

(52) U.S. Cl.
CPC *D04C 3/48* (2013.01); *D04C 3/40* (2013.01)

(58) Field of Classification Search
CPC ... D04C 3/48; D04C 3/40; D04C 3/00; D04C 3/36
See application file for complete search history.

(56) References Cited

U.S. PATENT DOCUMENTS

| | | | | | |
|---|---|---|---|---|---|
| 3,478,642 | A * | 11/1969 | Jurta | D04C 3/02 | 87/50 |
| 4,232,769 | A * | 11/1980 | Miro | D04C 3/00 | 475/14 |
| 4,913,028 | A * | 4/1990 | Yoshiya | D04C 3/38 | 87/50 |
| 4,916,997 | A | 4/1990 | Spain | | |
| 9,994,980 | B2 * | 6/2018 | Quick | D04C 3/48 | |
| 10,577,733 | B2 * | 3/2020 | Quick | D04C 1/12 | |
| 11,346,027 | B2 * | 5/2022 | Quick | D04C 3/48 | |
| 2010/0052203 | A1 * | 3/2010 | Inazawa | D04C 3/08 | 264/103 |
| 2010/0083815 | A1 * | 4/2010 | Inazawa | B29C 70/32 | 87/9 |
| 2018/0105963 | A1 * | 4/2018 | Quick | D04C 1/12 | |

(Continued)

FOREIGN PATENT DOCUMENTS

| | | | |
|---|---|---|---|
| CN | 1292441 | A | 4/2001 |
| CN | 103485068 | A | 1/2014 |

(Continued)

*Primary Examiner* — Bao-Thieu L Nguyen

(57) ABSTRACT

A mechanism for radially inserting a yarn into a 3D braided preform, including a first bracket, an upper linear actuator, a support mechanism, an upper yarn insertion device, a yarn carrying device, an upper gear ring, a lower yarn insertion device, a lower linear actuator, a second bracket, a lower gear ring, a lower gear, a lower motor, a lower circular track, an upper circular track, a base, an upper gear, a pneumatic transmission and control device and an upper motor.

6 Claims, 1 Drawing Sheet

(56) References Cited

U.S. PATENT DOCUMENTS

| | | | | |
|---|---|---|---|---|
| 2018/0274141 | A1* | 9/2018 | Quick | D04C 3/48 |
| 2018/0327945 | A1* | 11/2018 | Whitehead | D04C 3/00 |
| 2019/0161895 | A1* | 5/2019 | Li | D07B 1/148 |
| 2020/0270784 | A1* | 8/2020 | Quick | D04C 1/12 |
| 2021/0276282 | A1* | 9/2021 | Alarcon Lorente | D04C 3/48 |

FOREIGN PATENT DOCUMENTS

| | | | |
|---|---|---|---|
| CN | 203890598 | U | 10/2014 |
| CN | 208472313 | U | 2/2019 |
| CN | 209353045 | U | 9/2019 |

* cited by examiner

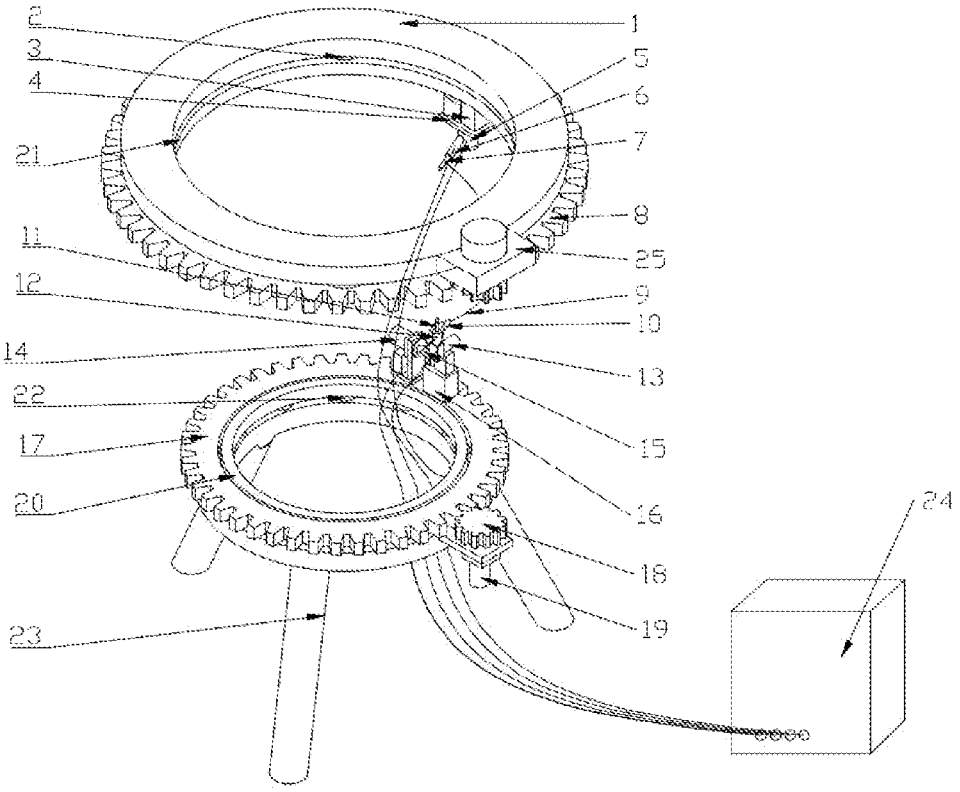
1
2
3
4
5
6
7
8
9
10
11
12
13
14
15
16
17
18
19
20
21
22
23
24
25

MECHANISM FOR RADIALLY INSERTING YARN INTO THREE-DIMENSIONAL BRAIDED PREFORM

CROSS-REFERENCE TO RELATED APPLICATIONS

This application claims the benefit of priority from Chinese Patent Application No. 202110577670.X, filed on May 26, 2021. The content of the aforementioned application, including any intervening amendments thereto, is incorporated herein by reference in its entirety.

TECHNICAL FIELD

The present disclosure relates to three-dimensional (3D) braiding machines, and more specifically to a mechanism for radially inserting yarn into a 3D braided preform.

BACKGROUND

The 3D braided composites are a class of emerging composites, which have a complex network structure composed of multi-directional yarns. The 3D braided composites can be used as a reinforcement to improve the interlayer bonding defects of traditional composite materials. Moreover, the radial introduction of yarns can increase the yarn direction in the preform. In addition to improving the performance along the original braiding direction, an in-plane performance of the preform is also enhanced. Nevertheless, the radial introduction of yarns is often performed manually, which leads to poor consistency of the preform, low efficiency and extended braiding cycle, limiting the application of the 3D multi-directional braiding technology to a certain extent.

SUMMARY

In view of the defects of the prior art, the present disclosure provides a mechanism for radially inserting a yarn into a 3D braided preform, which has desirable braiding efficiency and high degree of automation.

Technical solutions of the disclosure are described as follows.

A mechanism for radially inserting a yarn into a three-dimensional (3D) braided preform, comprising:

a first bracket;
an upper linear actuator;
a support mechanism;
an upper yarn insertion device;
a yarn carrying device;
an upper gear ring;
a lower yarn insertion device;
a lower linear actuator;
a second bracket;
a lower gear ring;
a lower gear;
a lower motor;
a lower circular track;
an upper circular track;
a base;
an upper gear;
a pneumatic transmission and control device; and
an upper motor;

wherein an interior of the upper gear ring is provided with the upper circular track; the first bracket is provided on the upper gear ring; the first bracket is connected to the upper circular track; the upper gear is engaged with the upper gear ring; the upper gear is connected to the upper motor; the support mechanism is provided below the upper gear ring; the support mechanism is connected to the upper linear actuator; the upper linear actuator is fixedly connected to the upper yarn insertion device; an interior of the lower gear ring is provided with the lower circular track; the base is provided below the lower gear ring; the lower gear ring is engaged with the lower gear; the lower gear is connected to the lower motor; the second bracket is provided on the lower gear ring; the second bracket is connected to the lower linear actuator; the lower linear actuator is fixedly connected to the lower yarn insertion device; the yarn carrying device is connected to the upper yarn insertion device or the lower yarn insertion device; and the pneumatic transmission and control device is connected to the upper linear actuator, the upper yarn insertion device, the lower yarn insertion device and the lower linear actuator;

the upper linear actuator comprises an upper X-direction linear actuator and an upper Y-direction linear actuator; and the upper X-direction linear actuator and the upper Y-direction linear actuator are connected to the pneumatic transmission and control device; and the lower linear actuator comprises a lower X-direction linear actuator and a lower Y-direction linear actuator; and the lower X-direction linear actuator and the lower Y-direction linear actuator are connected to the pneumatic transmission and control device.

In some embodiments, the mechanism further comprising:

a yarn tension control device; and
a yarn storage device;

wherein the yarn tension control device and the yarn storage device are arranged on the second bracket; the yarn storage device is connected to the yarn tension control device; and the yarn tension control device is connected to the pneumatic transmission and control device.

In some embodiments, the upper circular track is connected to the first bracket via a support.

In some embodiments, the lower circular track is connected to the base via a support.

In some embodiments, the upper yarn insertion device and the lower yarn insertion device are on the same axis.

In some embodiments, the yarn carrying device is provided with a sliding rod, a first locking pin and a second locking pin; the first locking pin and the second locking pin are arranged at two sides of the sliding rod, respectively; the upper yarn insertion device is provided with a first clamping groove and a first pneumatic rod; the lower yarn insertion device is provided with a second clamping groove and a second pneumatic rod; the sliding rod is connected to the first pneumatic rod and the second pneumatic rod; the first locking pin is connected to the first clamping groove or the second locking pin is connected to the second clamping groove; and the first pneumatic rod and the second pneumatic rod are connected to the pneumatic transmission and control device.

Compared to the prior art, the present disclosure has the following beneficial effects.

(1) With respect to the yarn radial insertion mechanism provided herein, through the combination of motor, gear drive and pneumatic transmission, the yarns are fed into a radial channel by the yarn carrying device; the yarn tension control device enables the tension control and length compensation during the radial insertion of yarns; and the yarn storage device stores yarns for continuous radial insertion.

Consequently, this application can achieve the automatic radial insertion of yarns, improve productivity and reduce the braiding time.

(2) By means of the pneumatic transmission and control device, the coordinated control of the yarn carrying device, yarn tension control device and the yarn storage device is enabled, achieving the precise radial insertion of the yarn and improving the overall performance of the preform.

BRIEF DESCRIPTION OF THE DRAWINGS

The FIGURE schematically depicts a structure of a mechanism for radially inserting yarns into a 3D braided preform according to an embodiment of the present disclosure.

In the drawings, 1, first bracket; 2, first support; 3, upper X-direction linear actuator; 4, support mechanism; 5, upper Y-direction linear actuator; 6, upper yarn insertion device; 7, yarn carrying device; 8, upper gear ring; 9, yarn; 10, lower yarn insertion device; 11, cylinder; 12, lower Y-direction linear actuator; 13; lower X-direction linear actuator; 14, yarn tension control device; 15, yarn storage device; 16, second bracket; 17, lower gear ring; 18, lower gear; 19, lower motor; 20, lower circular track; 21, upper circular track; 22, second support; 23, base; 24, pneumatic transmission and control device; and 25, upper motor.

DETAILED DESCRIPTION OF EMBODIMENTS

Technical solutions of the present disclosure will be described below with reference to the accompanying drawings and embodiments.

As shown in FIG. 1, a mechanism for radially inserting a yarn into a 3D braided preform includes a first bracket 1, an upper linear actuator, a support mechanism 4, an upper yarn insertion device 6, a yarn carrying device 7, an upper gear ring 8, a lower yarn insertion device 10, a lower linear actuator, a yarn tension control device 14, a yarn storage device 15, a second bracket 16, a lower gear ring 17, a lower gear 18, a lower motor 19, a lower circular track 20, an upper circular track 21, a base 23, an upper gear, a pneumatic transmission and control device 24 and an upper motor 25. An interior of the upper gear ring 8 is provided with the upper circular track 21. The first bracket 1 is provided on the upper gear ring 8. The first bracket 1 is connected to the upper circular track 21. The upper circular track 21 is connected to the upper gear ring 8 via four first supports 2. The four first supports 2 are evenly arranged along a circumference of the first bracket 1. The four first supports 2 have the same structure and the same size and are configured to fix the lower circular track 20 on the first bracket 1 to ensure a stability of the lower circular track 20. The upper gear is engaged with the upper gear ring 8. The upper gear is connected to the upper motor 25. By means of operating the upper motor 25, the upper gear is driven to rotate, such that the upper gear ring 8 is driven to circumferentially rotate through engaging. The support mechanism 4 is provided below the upper gear ring 8. The support mechanism 4 is connected to the upper linear actuator. The upper linear actuator is fixedly connected to the upper yarn insertion device 6. The pneumatic transmission and control device 24 is connected to the upper linear actuator and the upper yarn insertion device 6. The pneumatic transmission and control device 24 controls the upper linear actuator to enable the upper yarn insertion device 6 to reciprocate on plane. An interior of the lower gear ring 17 is provided with the lower circular track 20. The base 23 is provided below the lower gear ring 17. The lower circular track 20 is connected to the base 23 via multiple second supports 22. The lower gear ring 17 is engaged with the lower gear 18. The lower gear 18 is connected to the lower motor 19. The lower circular track 20 and the base 23 are relatively stationary during the lower motor 19 operating. Similarity, the second supports 22 are evenly arranged along a circumference of the base 23. The second supports 22 have the same structure and the same size. The second bracket 16 is provided on the lower gear ring 17. The second bracket 16 is connected to the lower linear actuator. The lower gear ring 17 is engaged with the lower gear 18 driven by the lower motor 19 to drive the second bracket 16 to perform a circular motion along the lower circular track 20. The lower motor 19 and the upper motor 25 are of the same type. The lower gear 18 and the upper gear have the same size and structure. A driving mode of the lower motor 19 driving the upper gear is same to a driving mode of the lower motor 19 driving the lower gear 18, such that the upper gear ring 8 is synchronized with the lower gear ring 17. The lower linear actuator is fixedly connected to the lower yarn insertion device 10. The yarn carrying device 7 is connected to the upper yarn insertion device 6 or the lower yarn insertion device 10. The pneumatic transmission and control device 24 is connected to the lower yarn insertion device 10 and the lower linear actuator. The pneumatic transmission and control device 24 controls the lower linear actuator to drive the lower yarn insertion device 10 to reciprocate on plane. The yarn storage device 15 and the yarn tension control device 14 are arranged on the second bracket 16 and capable of performing a circular motion with the lower gear ring 17. The yarn storage device 15 is connected to the yarn tension control device 14. The yarn tension control device 14 is connected to the pneumatic transmission and control device 24. The pneumatic transmission and control device 24 controls the yarn tension control device 14, so as to control a tension of a yarn led out from the yarn storage device 15. The yarn storage device 15 enables a continuous feeding during feeding the yarn.

The upper linear actuator includes an upper X-direction linear actuator 3 and an upper Y-direction linear actuator 5. The upper X-direction linear actuator 3 and the upper Y-direction linear actuator 5 are connected to the pneumatic transmission and control device 24. The lower linear actuator includes a lower Y-direction linear actuator 13 and a lower Y-direction linear actuator 12. The lower Y-direction linear actuator 13 and the lower Y-direction linear actuator 12 are connected to the pneumatic transmission and control device 24. The pneumatic transmission and control device 24 respectively drives the upper yarn insertion device 6 and the lower yarn insertion device 10 to move in a direction of plumb line and reciprocate on plane, such that the yarn can be radially inserted from anywhere in space. A cylinder 11 with a hole is fixed on the lower Y-direction linear actuator 12. A yarn 9 is connected to a yarn fixing device of the yarn carrying device 7 through the hole of the cylinder 11 to ensure a fixed inserting track during insertion to prevent interference. The yarn fixing device is configured to ensure the yarn carrying device 7 to be synchronized with a corresponding yarn insertion device.

The upper yarn insertion device 6 and the lower yarn insertion device 10 are on the same axis to prevent the yarn from interference. The upper yarn insertion device 6 and the lower yarn insertion device 10 are placed at two sides of a surface formed by the yarn during feeding, respectively. The upper yarn insertion device 6 and the lower yarn insertion device 10 are driven by the pneumatic transmission and control device 24 to drive the yarn carrying device 7 to move along an axial direction. The yarn carrying device 7 is provided with a sliding rod, a first locking pin and a second locking pin. The first locking pin and the second locking pin are arranged at two sides of the sliding rod, respectively. The upper yarn insertion device 6 is provided with a first clamping groove and a first pneumatic rod. The lower yarn insertion device 10 is provided with a second clamping groove and a second pneumatic rod. The sliding rod is connected to the first pneumatic rod and the second pneumatic rod. The first pneumatic rod and the second pneumatic rod are connected to the pneumatic transmission and control device 24. The first pneumatic pressure rod and the second pneumatic pressure rod are controlled by the pneumatic transmission and control device 24 to enable the first locking pin to connect to the first clamping groove or the second locking pin to connect to the second clamping groove, such that the yarn carrying device 7 is locked to the upper yarn insertion device 6 or the lower yarn insertion device 10. Specifically, when the sliding rod moves to left, the first locking pin is driven to move upward and the second locking pin is driven to move downward. The first locking pin is clamped into the first clamping groove and the second locking pin is released from the second clamping groove upon the sliding rod moving, such that the yarn carrying device 7 is locked to the upper yarn insertion device 6. When the sliding rod moves to right, the first locking pin is driven to move downward and the second locking pin is driven to move upward. The first locking pin is released from the first clamping groove and the second locking pin is clamped into the second clamping groove upon the sliding rod moving, such that the yarn carrying device 7 is locked to the lower yarn insertion device 10.

A working process is specifically described as follows. The yarn is led out of the yarn storage device 15 to the fixing device of the yarn carrying device 7. During the braiding process, the upper motor 25 and the lower motor 19 are operated to respectively drive the upper gear and the lower gear 18 to rotate to drive the upper gear ring 8 and the lower gear ring 17 to rotate along a circular track. The upper yarn insertion device 6 and the lower yarn insertion device 10 also perform a circular motion, while ensuring that the upper yarn insertion device 6 and the lower yarn insertion device 10 are on the same axis, so that the yarn carrying device 7 can stably reciprocate between the upper yarn insertion device 6 and the lower yarn insertion device 10. The yarn carrying device 7 is initially located at the lower yarn insertion device 10. The yarn carrying device 7 is fixed on the lower yarn insertion device 10 through a clamping groove and the second locking pin. The lower motor 19 and the upper motor 25 work synchronously to enable the upper yarn insertion device 6 and the lower yarn insertion device 10 to move to a position where the yarn insertion is required to be performed. When the upper yarn insertion device 6 is connected to the yarn carrying device 7, the first locking pin is fixed in the first clamping groove of the upper yarn insertion device 6, meanwhile, the second locking pin is released from the second clamping groove of the lower yarn insertion device 10. An extending part of the yarn carrying device 7 is retracted under an operation of the pneumatic transmission and control device 24, and then the lower yarn insertion device 10 is controlled by the pneumatic transmission and control device 24 to be connected to the yarn carrying device 7. The above processes are repeated to automatically and radially insert the yarn into the 3D braided preform.

Mentioned above are merely preferred embodiments of this disclosure, which are not intended to limit the scope of the present disclosure. It should be understood that any changes, modifications and replacements made by those killed in the art without departing from the spirit of this disclosure should fall within the scope of the present disclosure defined by the appended claims.

What is claimed is:

1. A mechanism for radially inserting a yarn into a three-dimensional (3D) braided preform, comprising:

a first bracket;
an upper linear actuator;
a support mechanism;
an upper yarn insertion device;
a yarn carrying device;
an upper gear ring;
a lower yarn insertion device;
a lower linear actuator;
a second bracket;
a lower gear ring;
a lower gear;
a lower motor;
a lower circular track;
an upper circular track;
a base;
an upper gear;
a pneumatic transmission and control device; and
an upper motor;

wherein an interior of the upper gear ring is provided with the upper circular track; the first bracket is provided on the upper gear ring; the first bracket is connected to the upper circular track; the upper gear is engaged with the upper gear ring; the upper gear is connected to the upper motor; the support mechanism is provided below the upper gear ring; the support mechanism is connected to the upper linear actuator; the upper linear actuator is fixedly connected to the upper yarn insertion device; an interior of the lower gear ring is provided with the lower circular track; the base is provided below the lower gear ring; the lower gear ring is engaged with the lower gear; the lower gear is connected to the lower motor; the second bracket is provided on the lower gear ring; the second bracket is connected to the lower linear actuator; the lower linear actuator is fixedly connected to the lower yarn insertion device; the yarn carrying device is connected to the upper yarn insertion device or the lower yarn insertion device; and the pneumatic transmission and control device is connected to the upper linear actuator, the upper yarn insertion device, the lower yarn insertion device and the lower linear actuator;

the upper linear actuator comprises an upper X-direction linear actuator and an upper Y-direction linear actuator; and the upper X-direction linear actuator and the upper Y-direction linear actuator are connected to the pneumatic transmission and control device; and the lower linear actuator comprises a lower X-direction linear actuator and a lower Y-direction linear actuator; and the lower X-direction linear actuator and the lower Y-direction linear actuator are connected to the pneumatic transmission and control device.

2. The mechanism of claim 1, further comprising:

a yarn tension control device; and
a yarn storage device;

wherein the yarn tension control device and the yarn storage device are arranged on the second bracket; the yarn storage device is connected to the yarn tension control device; and the yarn tension control device is connected to the pneumatic transmission and control device.

3. The mechanism of claim 1, wherein the upper circular track is connected to the first bracket via a support.

4. The mechanism of claim 1, wherein the lower circular track is connected to the base via a support.

5. The mechanism of claim 1, wherein the upper yarn insertion device and the lower yarn insertion device are on the same axis.

6. The mechanism of claim 1, wherein respectively; the upper yarn insertion device is provided with a first clamping groove and a first pneumatic rod; the lower yarn insertion device is provided with a second clamping groove and a second pneumatic rod; and the first pneumatic rod and the second pneumatic rod are connected to the pneumatic transmission and control device.

* * * * *